US008887508B2

(12) United States Patent
Brown et al.

(10) Patent No.: US 8,887,508 B2
(45) Date of Patent: Nov. 18, 2014

(54) IMPINGEMENT SLEEVE AND METHODS FOR DESIGNING AND FORMING IMPINGEMENT SLEEVE

(75) Inventors: Jerome David Brown, Simpsonville, SC (US); Ronald James Chila, Greenfield Center, NY (US); Patrick Benedict Melton, Horse Shoe, NC (US); Russell DeForest, Simpsonville, SC (US); David William Cihlar, Greenville, SC (US); Matthew Paul Berkebile, Mauldin, SC (US); Wei Chen, Greer, SC (US); John Drake Vanselow, Taylors, SC (US)

(73) Assignee: General Electric Company, Schenectady, NY (US)

( * ) Notice: Subject to any disclaimer, the term of this patent is extended or adjusted under 35 U.S.C. 154(b) by 915 days.

(21) Appl. No.: 13/048,394

(22) Filed: Mar. 15, 2011

(65) Prior Publication Data

US 2012/0234012 A1 Sep. 20, 2012

(51) Int. Cl.
*F23R 3/06* (2006.01)
*F01D 9/02* (2006.01)

(52) U.S. Cl.
CPC ..... *F01D 9/023* (2013.01); *F05D 2260/201* (2013.01); *F23R 2900/03044* (2013.01)
USPC ..... 60/754; 60/752; 60/758; 60/760; 703/6

(58) Field of Classification Search
CPC .. F01D 9/023; F23R 3/06; F23R 2900/03044; Y02T 50/675
USPC ..... 60/752, 754, 758, 760; 703/8
See application file for complete search history.

(56) References Cited

U.S. PATENT DOCUMENTS

| | | | | |
|---|---|---|---|---|
| 4,719,748 | A | 1/1988 | Davis, Jr. et al. | |
| 4,984,429 | A | 1/1991 | Waslo et al. | |
| 6,568,187 | B1 | 5/2003 | Jorgensen et al. | |
| 6,640,547 | B2 | 11/2003 | Leahy, Jr. | |
| 6,973,419 | B1 * | 12/2005 | Fortin et al. | 703/8 |
| 7,010,921 | B2 | 3/2006 | Intile et al. | |
| 7,082,766 | B1 | 8/2006 | Widener et al. | |

(Continued)

FOREIGN PATENT DOCUMENTS

| | | | |
|---|---|---|---|
| CN | 1644891 | A | 7/2005 |
| CN | 1704573 | A | 12/2005 |

(Continued)

OTHER PUBLICATIONS

Unofficial English translation of CN Office Action dated Nov. 29, 2013, issued in connection with corresponding CN Application No. 201210078966.8.

*Primary Examiner* — Phutthiwat Wongwian
*Assistant Examiner* — Steven Sutherland
(74) *Attorney, Agent, or Firm* — Dority & Manning, P.A.

(57) ABSTRACT

An impingement sleeve and methods for designing and forming an impingement sleeve are disclosed. In one embodiment, a method for designing an impingement sleeve is disclosed. The method includes determining a desired operational value for a transition piece, inputting a combustor characteristic into a processor, and utilizing the combustor characteristic in the processor to determine a cooling hole pattern for the impingement sleeve, the cooling hole pattern comprising a plurality of cooling holes, at least a portion of the plurality of cooling holes being generally longitudinally asymmetric, the cooling hole pattern providing the desired operational value.

20 Claims, 3 Drawing Sheets

(56) References Cited

U.S. PATENT DOCUMENTS

| | | | | |
|---|---|---|---|---|
| 7,147,432 | B2 | 12/2006 | Lowe et al. | |
| 7,493,767 | B2 | 2/2009 | Bunker et al. | |
| 7,617,684 | B2 | 11/2009 | Norster | |
| 7,707,835 | B2 | 5/2010 | Lipinski et al. | |
| 2008/0276619 | A1* | 11/2008 | Chopra et al. | 60/760 |
| 2008/0314044 | A1 | 12/2008 | Bronson et al. | |
| 2009/0249791 | A1 | 10/2009 | Belsom | |
| 2009/0252593 | A1 | 10/2009 | Chila et al. | |
| 2010/0037620 | A1 | 2/2010 | Chila | |
| 2010/0037622 | A1 | 2/2010 | Simo et al. | |
| 2010/0077761 | A1 | 4/2010 | Johnson et al. | |

FOREIGN PATENT DOCUMENTS

| | | | |
|---|---|---|---|
| CN | 1828140 | A | 9/2006 |
| CN | 101555833 | A | 10/2009 |
| CN | 101655238 | A | 2/2010 |

* cited by examiner

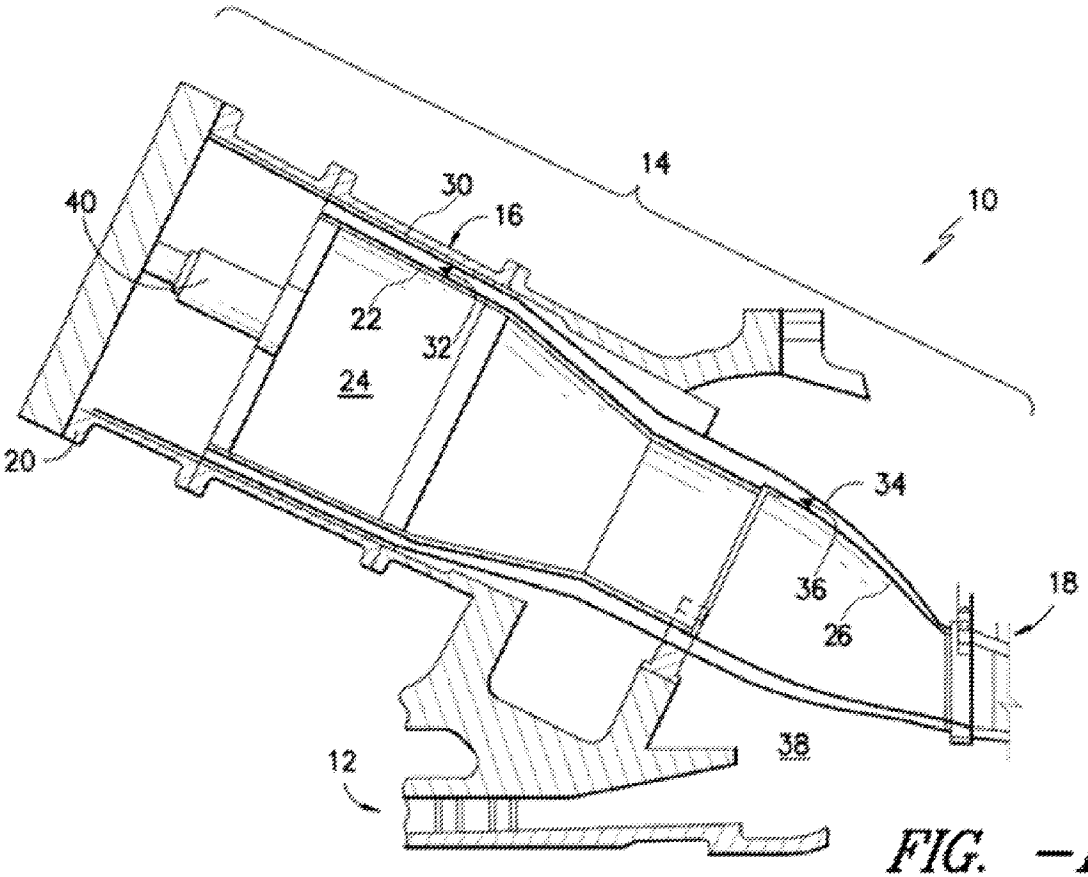
FIG. —1—

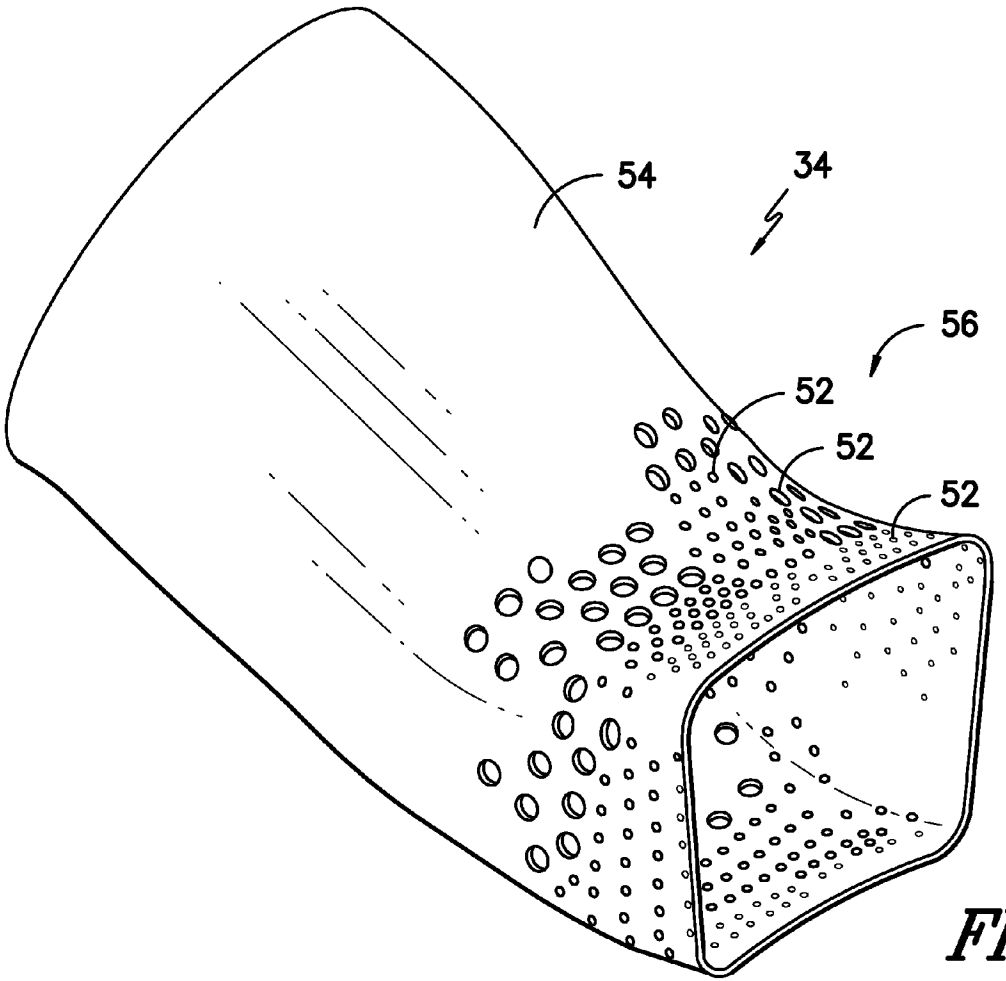
FIG. —2—

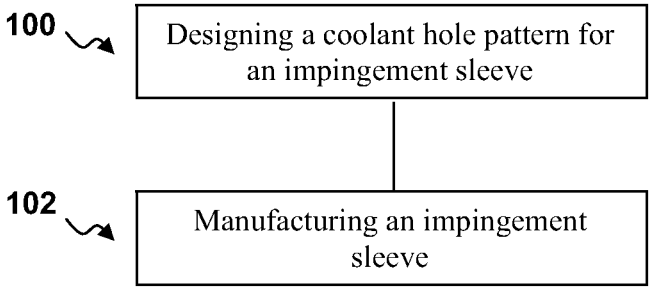
FIG. –3–
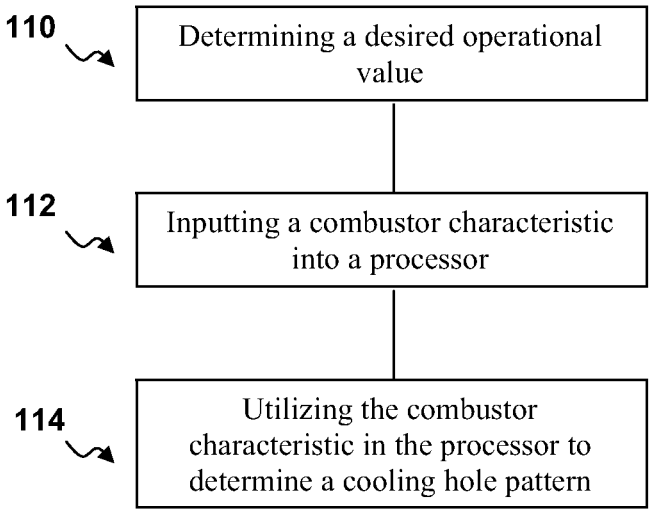
FIG. –4–

IMPINGEMENT SLEEVE AND METHODS FOR DESIGNING AND FORMING IMPINGEMENT SLEEVE

FIELD OF THE INVENTION

The present disclosure relates in general to combustors, and more particularly to impingement sleeves for combustors and methods for designing and forming the impingement sleeves.

BACKGROUND OF THE INVENTION

Turbine systems are widely utilized in fields such as power generation. For example, a conventional gas turbine system includes a compressor, a combustor, and a turbine. During operation of the turbine system, various components in the system may be subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

One such component that requires cooling during operation is the transition piece in the combustor. The transition piece is generally connected to the combustor liner, and provides a transition passage for hot gas flowing from the combustor liner to the turbine. Thus, the transition piece is exposed to high temperatures from the hot gas flowing therethrough, and generally requires cooling.

A typical combustor utilizes an impingement sleeve surrounding the transition piece and creating a flow path therebetween to cool the transition piece. Rows of similarly sized holes are defined in the impingement sleeve, and cooling air or other working fluids are flowed through the holes into the flow path. The working fluid flowing through the flow path may cool the transition piece.

As stated, typical impingement sleeves utilize rows of similarly sized holes for flowing working fluid therethrough. Each generally peripheral row has a plurality of identically sized, generally longitudinally symmetrical, holes. The size of the holes for a row generally decreases in the direction of the turbine. In many cases, this arrangement of cooling holes does not provide optimal cooling of the transition piece. For example, many transition pieces may include surface area portions that are particularly susceptible to excessive thermal loads. However, typical arrangements of cooling holes do not target these portions. Thus, cooling of these portions may be inadequate. Additionally, the current arrangement of cooling holes generally causes relatively large pressure drops, which may be disadvantageous for operation of the combustor and system in general.

Thus, improved impingement sleeves and methods for designing and forming impingement sleeves would be desired in the art. For example, impingement sleeves and methods that provided optimal, targeted cooling of transition pieces would be advantageous. Further, impingement sleeves and methods that reduced associated pressure drops would be advantageous.

BRIEF DESCRIPTION OF THE INVENTION

Aspects and advantages of the invention will be set forth in part in the following description, or may be obvious from the description, or may be learned through practice of the invention.

In one embodiment, a method for designing an impingement sleeve is disclosed. The method includes determining a desired operational value for a transition piece, inputting a combustor characteristic into a processor, and utilizing the combustor characteristic in the processor to determine a cooling hole pattern for the impingement sleeve, the cooling hole pattern comprising a plurality of cooling holes, at least a portion of the plurality of cooling holes being generally longitudinally asymmetric, the cooling hole pattern providing the desired operational value.

In another embodiment, a method for forming an impingement sleeve is disclosed. The method includes designing a cooling hole pattern for the impingement sleeve, the cooling hole pattern comprising a plurality of cooling holes, at least a portion of the plurality of cooling holes being generally longitudinally asymmetric, the cooling hole pattern configured to provide a desired operational value for a transition piece. The method further includes manufacturing an impingement sleeve, the impingement sleeve defining a plurality of cooling holes having the cooling hole pattern.

In another embodiment, an impingement sleeve for a combustor is disclosed. The impingement sleeve includes a body configured to at least partially surround a transition piece of the combustor. The impingement sleeve further includes a plurality of cooling holes defined in the body, the plurality of cooling holes having a cooling hole pattern configured to provide a desired operational value for the transition piece. At least a portion of the plurality of cooling holes are generally longitudinally asymmetric.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a cross-sectional view of several portions of a gas turbine system according to one embodiment of the present disclosure;

FIG. 2 is a perspective view of an impingement sleeve according to one embodiment of the present disclosure;

FIG. 3 is a flow chart illustrating a method for forming an impingement sleeve according to one embodiment of the present disclosure; and FIG. 4 is a flow chart illustrating a method for designing an impingement sleeve according to one embodiment of the present disclosure.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a simplified drawing of several portions of a gas turbine system 10 is illustrated. The system 10 comprises a compressor section 12 for pressurizing a working fluid, discussed below, that is flowing through the system 10. Pressurized working fluid discharged from the compressor section 12 flows into a combustor section 14, which is generally characterized by a plurality of combustors 16 (only one of which is illustrated in FIG. 1) disposed in an annular array about an axis of the system 10. The working fluid entering the combustor section 14 is mixed with fuel, such as natural gas or another suitable liquid or gas, and combusted. Hot gases of combustion flow from each combustor 16 to a turbine section 18 to drive the system 10 and generate power.

Each combustor 16 in the gas turbine 10 may include a variety of components for mixing and combusting the working fluid and fuel. For example, the combustor 16 may include a casing 20, such as a compressor discharge casing 20. A variety of sleeves, which may be generally annular sleeves, may be at least partially disposed in the casing 20. For example, a combustor liner 22 may generally define a combustion zone 24 therein. Combustion of the working fluid, fuel, and optional oxidizer may generally occur in the combustion zone 24. The resulting hot gases of combustion may flow downstream through the combustion liner 22 into a transition piece 26. A flow sleeve 30 may generally surround at least a portion of the combustor liner 22 and define a flow path 32 therebetween. An impingement sleeve 34 may generally surround at least a portion of the transition piece 26 and define a flow path 36 therebetween. Working fluid entering the combustor section 14 may flow in the casing 20 through an external annulus 38 defined by the casing 20 and at least partially surrounding the various sleeves. At least a portion of the working fluid may enter the flow paths 32 and 36 through holes (not shown) defined in the flow sleeve and 30 and impingement sleeve 34. As discussed below, the working fluid may then enter the combustion zone 24 for combustion.

The combustor 16 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

It should be readily appreciated that a combustor 16 need not be configured as described above and illustrated herein and may generally have any configuration that permits working fluid to be mixed with fuel, combusted and transferred to a turbine section 18 of the system 10. For example, the present disclosure encompasses annular combustors and silo-type combustors as well as any other suitable combustors.

FIG. 2 illustrates an impingement sleeve 34 according to one embodiment of the present disclosure. As shown, the impingement sleeve 34 may define a plurality of cooling holes 52. As discussed above, the cooling holes 52 may allow working fluid to flow therethrough into flow path 36, such that the working fluid may cool the transition piece 26. In general, the working fluid cools the transition piece 26 through two types of cooling—local impingement flow, wherein the working fluid travels through a cooling hole 52 and directly impacts a localized surface of the transition piece 26, and regional crossflow, wherein the working fluid travels generally through the flow path 36 proximate or adjacent to a region of the transition piece 26 surface.

In many cases, it may be desirable for the cooling of the transition piece 26 to provide one or more desired operation values for the transition piece 26, such as a generally uniform or average value. In general, an operational value is a condition of the transition piece 26 or a portion thereof that, during operation of the system 10, can be affected by cooling of the transition piece 26. Thus, a desired operational value is a desired value, whether uniform, average, or otherwise, for that characteristic. For example, in some exemplary embodiments, a desired operational value may be a generally uniform and/or average low cycle fatigue value, a generally uniform and/or average temperature, such as outer or inner surface temperature, a generally uniform and/or average strain, a generally uniform and/or average cooling value, and/or a generally uniform and/or average thermal barrier coating temperature, or at least one of the above. It should be understood, however, that the present disclosure is not limited to the above disclosed desired operational values, and rather that any suitable desired operational values, whether generally uniform, average, or otherwise, are within the scope and spirit of the present disclosure.

Thus, the impingement sleeve 34 of the present disclosure may include a body 54 configured to at least partially surround a transition piece 26, as discussed above. Further, the impingement sleeve 34 may include a plurality of cooling holes 52 defined in the body 54. Advantageously, the cooling holes 52 may have a cooling hole pattern 56 configured to provide a desired operational value or a plurality of desired operational values for the transition piece 26 that the impingement sleeve 34 at least partially surrounds. Further, the cooling hole pattern 56 may be configured to improve the desired operational value or values. In general, at least a portion, or all, of the cooling holes 52 in the cooling hole pattern 56 may be generally longitudinally asymmetric. The longitudinal direction may generally be defined as the direction of flow of hot gas through the transition piece 26. Thus, at least a portion, or all, of the cooling holes may be generally asymmetric about a line drawn in the longitudinal direction. The asymmetry may result from, for example, the size of the cooling holes 52, the shape of the cooling holes 52, the spacing between the cooling holes 52, the number of cooling holes 52, or any other suitable asymmetric feature of the various cooling holes 52 of the cooling hole pattern 56. The cooling hole pattern 56 may thus be modeled to provide the desired operational value or plurality of desired operational values.

Thus, as shown in FIGS. 3 and 4, the present disclosure is further directed to novel methods for designing and forming impingements sleeves 34. The impingement sleeves 34 may comprise cooling hole patterns 56 configured to provide a desired operational value or a plurality of desired operational values for the transition piece 26 that the impingement sleeve 34 is designed to at least partially surround. FIG. 3 is a flow chart illustrating one embodiment of a method for forming an impingement sleeve 34, while FIG. 4 is a flow chart illustrating one embodiment of a method for designing an impingement sleeve 34. It should be understood that the steps as shown in FIGS. 3 and 4 and described herein need not be described in any specific order, but rather that any suitable order and/or combination of steps is within the scope and spirit of the present disclosure.

Thus, as shown in FIG. 3, the method for forming an impingement sleeve 34 according to the present disclosure may thus include, for example, designing a cooling hole pattern 56 for the impingement sleeve 34, as represented by reference numeral 100. The cooling hole pattern 56 may be configured to provide a desired operational value or values for a transition piece 26. The method may further include manufacturing the impingement sleeve 34, as represented by reference numeral 102. The impingement sleeve 34, after manufacturing, may define a plurality of cooling holes 52 having the cooling hole pattern 56. The manufacturing step 102 may comprise, for example, drop forging, casting, or any other suitable manufacturing process. The cooling holes 52 may be defined in the body 54 of the impingement sleeve 34 during, for example, drop forging or casting, or may be defined in the impingement sleeve 34 after the body 54 is, for example, drop forged or casted. For example, in some embodiments, the cooling holes 52 may be drilled into or otherwise defined in the body 54.

The designing step 100 may include a variety of steps that may be included in the method for designing an impingement sleeve 34, as shown in FIG. 4. For example, the designing step 100 may include the step of determining a desired operational value or a plurality of desired operational values for a transition piece 26, as discussed above and as represented by reference numeral 110. The determining step 100 may involve, for example, choosing a desired operation value or values for which the cooling hole pattern 56 will be designed.

Further, the designing step 100 may include, for example, inputting a combustor characteristic or a plurality of combustor characteristics into a processor, as represented by reference numeral 112. In general, a combustor characteristic is a feature of a combustor 16 or component thereof, such as a transition piece 26 or impingement sleeve 34, which, during operation of the system 10, may affect cooling of the transition piece 26. For example, a combustor characteristic may be hot gas temperature, working fluid temperature, transition piece 26 stress, transition piece 26 strain, transition piece 26 material, impingement sleeve 34 geometry, spacing between impingement sleeve 34 and transition piece 26, number of cooling holes 52, number of cooling hole 52 sizes, cooling hole 52 sizes, or total area of cooling holes 52, or at least one of the above.

In some embodiments, for example, a combustor characteristic may be the number of cooling hole 52 sizes. In exemplary embodiments, the number of cooling hole 52 sizes may be in the range between 2 and 10, although it should be understood that any suitable number or range of cooling hole 52 sizes is within the scope and spirit of the present disclosure. Additionally or alternatively, a combustor characteristic may be cooling hole 52 sizes. In exemplary embodiments, the sizes of various cooling holes 52 may be 0.0625 inches in diameter, 0.125 inches in diameter, 0.25 inches in diameter, 0.5 inches in diameter, 0.75 inches in diameter, or any other suitable size or range of sizes.

It should be understood, however, that the present disclosure is not limited to the above disclosed combustor characteristics, and rather that any suitable combustor characteristics, whether generally of the transition piece 26, impingement sleeve 34, or otherwise, are within the scope and spirit of the present disclosure.

As stated above, the combustor characteristic or characteristics may be input into a processor. In exemplary embodiments, the processor may be a computer. The computer may generally include hardware and/or software that may allow for a cooling hole pattern 56 to be designed for an impingement sleeve 34 based on inputs, such as combustor characteristics, and suitable algorithms. It should be understood that the term "processor" is not limited to integrated circuits referred to in the art as a computer, but broadly refers to a controller, a microcontroller, a microcomputer, a programmable logic controller (PLC), an application specific integrated circuit, and other programmable circuits, and these terms are used interchangeably herein. It should be understood that a processor and/or a control system can also include memory, input channels, and/or output channels.

The designing step 100 may further include, for example, utilizing the combustor characteristic or plurality of combustor characteristics in the processor to determine the cooling hole pattern 56, as represented by reference numeral 114. For example, as discussed above, the processor may contain suitable hardware and/or software containing suitable algorithms for producing a cooling hole pattern 56 based on a variety of inputs. Thus, after the inputs, such as the combustor characteristic and other various inputs as discussed below, are input into the processor, the processor may output a cooling hole pattern 56 for an impingement sleeve 34 that is configured to provide a desired operational value or operational values for a transition piece 26, as discussed above.

The designing step 100 may further include, for example, determining a heat flux of the transition piece 26. Heat flux is the rate of heat transfer through a surface. Thus, the heat flux of the transition piece 26 may be determined for the entire surface of the transition piece 26 or any portion thereof. The heat flux may be determined experimentally or analytically using any suitable device and/or process. The heat flux, after being determined, may be input into the processor to further assist in the design of the cooling hole pattern 56.

The designing step 100 may further include, for example, determining a required cooling mode for a desired operational value or values. As discussed above, the cooling types utilized to cool the transition piece 26 may be localized impingement flow and regional crossflow. For various portions of the surface of the transition piece 26, it may be desirable for the cooling mode for that portion to include one or both of the cooling types in various quantities, in order to provide desirable cooling characteristics. Thus, these cooling types and various quantities or ranges of quantities of cooling flow for the cooling types may be determined for the entire surface of the transition piece 26 or any portion thereof. The cooling mode for a specified portion of the surface of the transition piece 26 may include one or both cooling types in various quantities or ranges of quantities, which may provide a balance of cooling types to provide optimal cooling of that surface portion. Further, in some embodiments, the cooling mode may be dependent on the heat flux. For example, the cooling mode for various portions of the surface of the transition piece 26 may be determined based on the size and number of higher temperature spots or regions on the portion, which may be determined by determining the heat flux. Smaller and/or hotter spots may be better cooled using a cooling mode including more impingement flow and less regional crossflow, while larger and/or less hot spots may be better cooled using a cooling mode including more regional crossflow and less impingement flow. The cooling mode, after being determined, may be input into the processor to further assist in the design of the cooling hole pattern 56.

The designing step may further include, for example, partitioning the transition piece 26 into a plurality of segments. Each segment may include a portion of the surface of the transition piece 26. For example, in some embodiments, each segment may include a generally peripheral segment of the transition piece 26. The cooling hole pattern 56 may be designed for the impingement sleeve 34 with respect to each of the plurality of segments of the transition piece 26. Thus, for example, a portion of the cooling hole pattern 56 may be designed for a segment of the transition piece 26. This resulting portion of the cooling hole pattern 56 may, in some embodiments, be input into the processor to further assist in the design of the cooling hole pattern 56. Another portion of the cooling hole pattern 56 may then be designed for another segment of the transition piece 26, and so on, until the cooling hole pattern 56 has been fully designed. Thus, in some exemplary embodiments, various of the above disclosed steps may be performed for segments of the transition piece 26, rather than the entire transition piece 26, to design the cooling hole pattern 56.

Further, after a cooling hole pattern 56 is determined for a transition piece 26 segment, that cooling hole pattern 56 may be utilized to determine the cooling hole pattern 56 for other transition piece 26 segments. Thus, the design of the cooling hole pattern 56 for each segment may be dependent on the pattern 56 for other segments. The pattern 56 of various segments may be revised as the patterns for other segments are designed, and the methods, or various portions thereof, herein may thus in general be iterative.

Thus, the impingement sleeves and methods of the present disclosure may provide optimal, targeted cooling of transition pieces 26. This cooling may provide one or more desired operational values for the transition piece 26, as desired. Further, the optimal, targeted cooling may reduce the pressure drop associated with cooling of the transition piece or provide more efficient or more optimal cooling for a given pressure drop, thus allowing for more efficient performance of the combustor 16 and system 10 in general.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for forming an impingement sleeve, the method comprising:

designing a cooling hole pattern for the impingement sleeve, the cooling hole pattern comprising a plurality of cooling holes, at least a portion of the plurality of cooling holes arranged along a circumferential line about a longitudinal direction having size differences that are generally asymmetric about the longitudinal direction, the cooling hole pattern configured to provide a desired operational value for a transition piece; and manufacturing an impingement sleeve, the impingement sleeve defining the plurality of cooling holes having the cooling hole pattern.

2. The method of claim 1, wherein the designing step comprises determining a heat flux of the transition piece.

3. The method of claim 1, wherein the designing step comprises determining the desired operational value.

4. The method of claim 1, wherein the desired operational value is at least one of a generally uniform low cycle fatigue value, an average low cycle fatigue value, a generally uniform temperature, an average temperature, a generally uniform strain, an average strain, a generally uniform cooling value, an average cooling value, a generally uniform thermal barrier coating temperature, or an average thermal barrier coating temperature.

5. The method of claim 1, wherein the designing step comprises:

inputting a combustor characteristic into a processor; and utilizing the combustor characteristic in the processor to determine the cooling hole pattern.

6. The method of claim 5, wherein the combustor characteristic is at least one of hot gas temperature, working fluid temperature, transition piece stress, transition piece strain, transition piece material, impingement sleeve geometry, spacing between impingement sleeve and transition piece, number of cooling holes, number of cooling hole sizes, cooling hole sizes, or total area of cooling holes.

7. The method of claim 1, wherein the designing step comprises determining a required cooling mode for the desired operational value, the required cooling mode comprising one of impingement flow, regional crossflow, or both impingement flow and regional crossflow.

8. The method of claim 1, wherein the designing step comprises partitioning the transition piece into a plurality of segments, wherein the cooling hole pattern is designed for the impingement sleeve with respect to each of the plurality of segments.

9. A method for designing an impingement sleeve, the method comprising:

determining a desired operational value for a transition piece;

inputting a combustor characteristic into a processor; and utilizing the combustor characteristic in the processor to determine a cooling hole pattern for the impingement sleeve, the cooling hole pattern comprising a plurality of cooling holes, at least a portion of the plurality of cooling holes arranged along a circumferential line about a longitudinal direction having size differences that are generally asymmetric about the longitudinal direction, the cooling hole pattern providing the desired operational value.

10. The method of claim 9, further comprising determining a heat flux of the transition piece.

11. The method of claim 9, wherein the desired operational value is at least one of a generally uniform low cycle fatigue value, an average low cycle fatigue value, a generally uniform temperature, an average temperature, a generally uniform strain, an average strain, a generally uniform cooling value, an average cooling value, a generally uniform thermal barrier coating temperature, or an average thermal barrier coating temperature.

12. The method of claim 9, wherein the combustor characteristic is at least one of hot gas temperature, working fluid temperature, transition piece stress, transition piece strain, transition piece material, impingement sleeve geometry, spacing between impingement sleeve and transition piece, number of cooling holes, number of cooling hole sizes, cooling hole sizes, or total area of cooling holes.

13. The method of claim 9, further comprising determining a required cooling mode for the desired operational value, the required cooling mode comprising one of impingement flow, regional crossflow, or both impingement flow and regional crossflow.

14. The method of claim 9, further comprising partitioning the transition piece into a plurality of segments, wherein a cooling hole pattern is determined for the impingement sleeve with respect to each of the plurality of segments.

15. The method of claim 9, further comprising determining a plurality of desired operational values.

16. The method of claim 9, further comprising inputting a plurality of combustor characteristics.

17. An impingement sleeve for a combustor, comprising:

a body configured to at least partially surround a transition piece of the combustor; and a plurality of cooling holes defined in the body, the plurality of cooling holes having a cooling hole pattern configured to provide a desired operational value for the transition piece, wherein at least a portion of the plurality of cooling holes arranged along a circumferential line about a longitudinal direction have size differences that are generally asymmetric about the longitudinal direction.

18. The impingement sleeve of claim 17, wherein the desired operational value is at least one of a generally uniform low cycle fatigue value, an average low cycle fatigue value, a generally uniform temperature, an average temperature, a generally uniform strain, an average strain, a generally uniform cooling value, an average cooling value, a generally uniform thermal barrier coating temperature, or an average thermal barrier coating temperature, or an average thermal barrier coating temperature.

19. The impingement sleeve of claim 17, wherein the cooling hole pattern is designed by determining the desired operational value for the transition piece, inputting a combustor characteristic into a processor, and utilizing the combustor characteristic in the processor to determine the cooling hole pattern for the impingement sleeve.

20. The impingement sleeve of claim 19, wherein the combustor characteristic is at least one of hot gas temperature, working fluid temperature, transition piece stress, transition piece strain, transition piece material, impingement sleeve geometry, spacing between impingement sleeve and transition piece, number of cooling holes, number of cooling hole sizes, cooling hole sizes, or total area of cooling holes.

* * * * *